US011497676B2

(12) United States Patent
Liu et al.

(10) Patent No.: US 11,497,676 B2
(45) Date of Patent: Nov. 15, 2022

(54) PERCUSSIVE MASSAGE DEVICE

(71) Applicant: ZHUHAI YUNMAI TECHNOLOGY CO. LTD., Zhuhai (CN)

(72) Inventors: Zun Liu, Zhuhai (CN); Yang Wang, Zhuhai (CN); Zhengliao Yu, Zhuhai (CN)

(73) Assignee: ZHUHAI YUNMAI TECHNOLOGY CO. LTD., Zhuhai (CN)

( * ) Notice: Subject to any disclaimer, the term of this patent is extended or adjusted under 35 U.S.C. 154(b) by 381 days.

(21) Appl. No.: 16/865,313

(22) Filed: May 2, 2020

(65) Prior Publication Data

US 2021/0113427 A1 Apr. 22, 2021

(30) Foreign Application Priority Data

Oct. 16, 2019 (CN) ..... 201921733494.9
Apr. 17, 2020 (CN) ..... 202020579004.0

(51) Int. Cl.
*A61H 23/02* (2006.01)
*A61H 23/00* (2006.01)

(52) U.S. Cl.
CPC ..... *A61H 23/0254* (2013.01); *A61H 23/006* (2013.01); *A61H 2201/0153* (2013.01); *A61H 2201/0165* (2013.01); *A61H 2201/149* (2013.01)

(58) Field of Classification Search
CPC .. A61H 1/006; A61H 1/008; A61H 23/00–06; A61H 2023/002–029
(Continued)

(56) References Cited

U.S. PATENT DOCUMENTS

2019/0254921 A1 8/2019 Marton et al.
2019/0254922 A1* 8/2019 Marton ..... A61H 23/006
2020/0289364 A1* 9/2020 Zhou ..... A61H 23/0263

FOREIGN PATENT DOCUMENTS

CN 110251380 A * 9/2019
CN 209751603 U * 12/2019
(Continued)

OTHER PUBLICATIONS

English translation of KR-101895191-B1. Accessed from Espacenet Jul. 5, 2022. (Year: 2018).*
(Continued)

*Primary Examiner* — Valerie L Woodward
*Assistant Examiner* — Paige Kathleen Bugg

(57) ABSTRACT

A percussion massager comprises a motor, a reciprocating assembly, a mallet, a power source, a housing, and a fixing frame. The motor, the reciprocating assembly and the power source are operably arranged in the housing. The motor comprises a main body and a first rotary shaft. Part of the mallet is not located in the housing. The first rotary shaft of the motor is operably mechanically connected with the reciprocating assembly. The reciprocating assembly is mechanically connected with the mallet. The fixing frame is installed in the housing. The main body of the motor and the reciprocating assembly are installed on the fixing frame. The main body of the motor and the reciprocating assembly are installed in the housing via the fixing frame only. When the motor is electrically connected with the power source, it rotates to drive the reciprocating assembly to reciprocate under the driving of the power source, thereby driving the mallet to make reciprocating linear motion for repeated striking.

17 Claims, 12 Drawing Sheets

(58) Field of Classification Search
USPC ..... 601/108
See application file for complete search history.

(56) References Cited

FOREIGN PATENT DOCUMENTS

| | | | | |
|---|---|---|---|---|
| CN | 209751603 | U | | 12/2019 |
| KR | 101162978 | B1 | * | 7/2012 |
| KR | 101895191 | B1 | * | 9/2018 |

OTHER PUBLICATIONS

English translation of CN-110251380-A. Accessed from Espacenet Jul. 5, 2022. (Year: 2019).*
English translation of CN-209751603-U. Accessed from Espacenet Jul. 1, 2022. (Year: 2019).*
English translation of KR-101162978-B1. Accessed from Espacenet Jul. 5, 2022. (Year: 2012).*

* cited by examiner

PRIOR ART

PRIOR ART

PRIOR ART

PERCUSSIVE MASSAGE DEVICE

RELATED APPLICATIONS

This application claims the benefit of the Chinese utility model application CN201921733494.9 filed Oct. 16, 2019 and the Chinese utility model application CN202020579004.0 filed Apr. 17, 2020, each of which is incorporated herein by reference in its entirety.

FIELD OF THE INVENTION

The invention belongs to the field of therapeutic equipment, in particular to the field of equipment for applying percussion massage on body parts.

BACKGROUND OF THE INVENTION

Percussion massage involves quick tapping, striking or cupping on body parts. It is used for exercising and strengthening deep tissue muscles aggressively, and can enhance local blood circulation and even strengthen muscle areas. It can be applied by a skilled massage therapist through rapid hand movement. However, percussion massage is delivered either gently or hard, and the massage therapist may feel tired before finishing the whole treatment program. A percussion massager is a good tool for assisting the stretching recovery after exercise and can relieve muscle spasm and increase blood flow by frequent vibration to greatly shorten the muscle recovery time. It is available to both professional athletes and amateur bodybuilders.

The percussion massager works in such a way that a motor drives a telescopic sleeve at the front end to make reciprocating motion, so as to realize vibration. Percussion massage equipment disclosed in prior arts (for example, the U.S. invention patent U.S. Pat. No. 10,492,984 issued on Dec. 3, 2019) is shown in FIGS. 1-3 (i.e. FIG. 3, FIG. 11B and FIG. 12 in the U.S. invention patent). The motor 310 is fixed to the mounting bracket 320 via multiple mounting screws 322. The mounting bracket comprises multiple mounting ears 324 (e.g. four ears). Each mounting ear comprises a central hole 326, which receives a corresponding rubber ring 330 with its first and second expanded parts located on the opposite surfaces of the ear. Corresponding bracket mounting screws 332 each equipped with a gasket pass through corresponding central holes 334 in each ring to get connected with corresponding mounting holes 336 in an upper housing part 112 (FIG. 2). FIG. 3 shows two of the four mounting holes. The rings serve as vibration dampers between the mounting bracket and the upper housing part. A substantially cylindrical motor casing 120 extends upwards from the upper housing part 112, and is approximately perpendicular to the upper housing part and closed by a motor casing end cover 122. The motor casing and the upper housing part accommodate a motor assembly 124 (FIG. 1). The upper housing part also supports a reciprocating assembly 126 which is operably connected to the motor assembly (FIG. 1).

The motor and the reciprocating assembly of the percussion massage equipment in prior arts are both fixed at the upper housing. The connection between the motor and the upper housing only depends on the elongated mounting holes extending downwards from the inner surface of the upper housing to get fixed with the housing, and the vibration caused when the motor and the reciprocating assembly operate is directly transmitted via the mounting holes to a high position of the machine body. Moreover, a user holds the lower end of the machine body, which keeps quite a distance from the vibration source, and the user will feel a large vibration. Since the motor is fixed only by the elongated mounting holes, the vibration fails to be absorbed by the machine body rigidity and the vibration of the upper housing is further transmitted to the lower housing, so that loud noise is generated due to collision between the parts. When the percussion massager in operation gets close to the head of a user, he/she will feel the loud noise and therefore feel unsafe. As a result, it is inconvenient to use the percussion massager in a quiet environment.

OBJECTS AND SUMMARY OF THE INVENTION

The percussion massager of the present invention has its power elements all mounted on a fixing frame. The fixing frame provides a platform having an area equivalent to a motor structure and a solid structure to mount the motor, as well as a guide ring to restrict a reciprocating assembly so that it can only make reciprocating linear motion along a horizontal direction. The vibration caused by the operating motor and the torque generated by the operating reciprocating assembly are counteracted and absorbed by rigidity of the fixing frame, to the greatest extent. Damping devices are also mounted between the fixing frame and a housing to reduce the vibration and noise during the operation of the percussion massager. The inventive percussion massager is adapted to use in a quiet environment, and can relax a user while allowing him/her to enjoy music or peace, and offer him/her more sense of safety and comfort.

The inventive percussion massager comprises a motor, a reciprocating assembly, a mallet, a power source, a housing and a fixing frame. The motor, the reciprocating assembly and the power source are operably arranged in the housing. The motor comprises a main body and a first rotary shaft. Part of the mallet is not located in the housing. The first rotary shaft of the motor is operably mechanically connected with the reciprocating assembly which is further mechanically connected with the mallet. The fixing frame is mounted in the housing. The main body of the motor and the reciprocating assembly are mounted on the fixing frame and further in the housing only via the fixing frame. When the motor is electrically connected with the power source, it rotates to drive the reciprocating assembly to reciprocate under the driving of the power source, thereby driving the mallet to make reciprocating linear motion for repeated striking. The first rotary shaft defines a vertical axis of the percussion massager, while the reciprocating linear motion direction of the mallet defines a horizontal axis of it.

According to one embodiment of the invention, the housing comprises an upper housing and a lower housing. The fixing frame divides the inner space of the housing into an upper space and a lower space. The main body of the motor is located in the upper space, while the reciprocating assembly is located in the lower space.

According to one embodiment of the invention, the fixing frame comprises a left segment and a right segment. The main body of the motor is fixed at the right segment, while the reciprocating assembly is mounted at the left segment.

According to one embodiment of the invention, the right segment comprises a platform and a hole surrounded by the platform. The main body of the motor is fixed on the platform. The first rotary shaft passes through the hole and extends to the lower space to get operably connected with the reciprocating assembly. The left segment has a guide ring, which limits the freedom of motion of the reciprocating assembly, so that the reciprocating assembly can only make reciprocating linear motion along the direction of the horizontal axis.

According to one embodiment of the invention, the platform is parallel to and above the horizontal axis. The plane defined by the opening of the guide ring is parallel to the vertical axis. The horizontal axis passes through the center of the guide ring.

According to one embodiment of the invention, the fixing frame further comprises a middle segment between the left and right segments. The reciprocating assembly extends below the middle segment.

According to one embodiment of the invention, the left, middle and right segments are integrally formed of a rigid material to constitute the fixing frame.

According to one embodiment of the invention, the reciprocating assembly comprises an eccentric wheel and a link rod.

According to one embodiment of the invention, the vertical axis sequentially passes through the upper housing, the main body of the motor, the first rotary shaft, the eccentric wheel, the link rod and the lower housing from top down.

According to one embodiment of the invention, the eccentric wheel has a sheet-like structure with its main plane parallel to the horizontal plane. It comprises first and second butt joints located at different horizontal positions, i.e. the upper side and the lower side of the sheet-like structure of the eccentric wheel, respectively.

According to one embodiment of the invention, the mass of the eccentric wheel on the first butt joint side is greater than that on the second butt joint side.

According to one embodiment of the invention, the link rod has a strip structure including a right end and a left end, and extends leftwards from the right end to the left end along the horizontal direction.

According to one embodiment of the invention, the mass of the right end is greater than that of the left end.

According to one embodiment of the invention, the part between the left and right ends of the link rod is prepared from a deformable material.

According to one embodiment of the invention, the first butt joint is fixedly connected with the first rotary shaft. The second butt joint is rotatably connected with the right end of the link rod. The mallet is detachably connected with the left end of the link rod. When the motor is electrically connected with the power source, the first rotary shaft rotates the eccentric wheel via the first butt joint, and the eccentric wheel drives, via the second butt joint, the link rod to make reciprocating linear motion along the horizontal direction. As a result, the mallet connected with the left end of the link rod makes reciprocating linear motion to deliver repeated striking.

According to one embodiment of the invention, the first butt joint of the eccentric wheel has a hole where the first rotary shaft passes to get fixedly connected with the eccentric wheel.

According to one embodiment of the invention, a screw horizontally passes through the first butt joint of the eccentric wheel to get abutted against the first rotary shaft in the hole of the first butt joint.

According to one embodiment of the invention, the second butt joint of the eccentric wheel has a second rotary shaft. The right end of the link rod has a hole in which the second rotary shaft is rotatably inserted. When rotating around the vertical axis, the second rotary shaft drives the link rod to make reciprocating linear motion along the direction of the horizontal axis.

According to one embodiment of the invention, a first bearing in the hole of the right end of the link rod is rotatably located between the hole and the second rotary shaft. A screw passes through the first bearing and the hole to get locked in the second rotary shaft, thereby rotatably connecting the eccentric wheel with the link rod.

According to one embodiment of the invention, a connector is arranged between the mallet and the left end of the link rod, and has its right end rotatably connected with the left end of the link rod and its left end detachably connected with the mallet.

According to one embodiment of the invention, the left end of the link rod has a hole in which a second bearing is arranged. A screw passes through the second bearing and the hole to get locked in the right end of the connector.

According to one embodiment of the invention, a notch is formed at the right end of the connector to receive the left end of the link rod. A sleeve is formed at the left end of the connector and detachably connected with the mallet.

According to one embodiment of the invention, the connector passes through the guide ring, and has its freedom of motion limited by the guide ring so that it can only make reciprocating linear motion along the horizontal direction.

According to one embodiment of the invention, the left end of the fixing frame has a lip side extending leftwards from the guide ring along the direction of the horizontal axis.

According to one embodiment of the invention, the fixing frame has aprons extending vertically downwards from the edge of the fixing frame.

According to one embodiment of the invention, the aprons of the right and middle segments of the fixing frame are located above and below the horizontal axis, respectively.

According to one embodiment of the invention, the distance from the lowest point of the apron on the rightmost side of the fixing frame to the horizontal plane passing through the horizontal axis is a first distance, and the distance from the lowest point of the apron on the leftmost side to the horizontal plane is a third distance. The distance from the lowest point of the apron held between the aprons mentioned above to the horizontal plane is a second distance. The third distance is larger than the first one, and the first distance is larger than the second one.

According to one embodiment of the invention, the connection between the right and middle segments of the fixing frame is provided with a plurality of ribs including first and second ribs. The plane defined by the plurality of ribs is perpendicular to the horizontal plane. The plane defined by the first rib is not parallel to that defined by the second rib.

According to one embodiment of the invention, damping devices are arranged at the connections between the fixing frame and the upper and lower housings and in the periphery of the right end of the fixing frame.

According to one embodiment of the invention, the connector is wrapped by a nonelastic lantern ring which is further wrapped by an elastic lantern ring. The connector wrapped by the multiple layers of the lantern rings has its freedom of motion restricted by the left end of the fixing frame, and makes reciprocating linear motion along the horizontal axis under the driving of the motor.

According to one embodiment of the invention, the housing further comprises a front housing provided with a hole and located at the leftmost end of the housing. The mallet extends out of the housing from the hole of the front housing.

According to one embodiment of the invention, a damping ring is sandwiched between the front housing and the connector and between the upper and lower housings.

According to one embodiment of the invention, the upper housing follows the contour of the main body of the motor to form a bump structure. A handgrip is formed from the lower housing. The power source comprises a battery installed in the space inside the handgrip.

According to one embodiment of the invention, the vertical axis passes through all of the following structures: the bump structure of the upper housing, the motor, the right segment of the fixing frame, the eccentric wheel, the link rod, the battery and the handgrip formed from the lower housing.

According to one embodiment of the invention, the horizontal axis passes through all of the following structures: the front housing, the damping ring, the elastic lantern ring, the nonelastic lantern ring, the connector, the left segment of the fixing frame, the middle segment of the fixing frame, the right segment of the fixing frame, the upper housing and the lower housing.

BRIEF DESCRIPTION OF FIGURES

The percussion massager of the invention will be described in detail below in conjunction with the accompanying drawings. In the drawings.

DETAILED DESCRIPTION OF THE EMBODIMENTS

Figure 1:
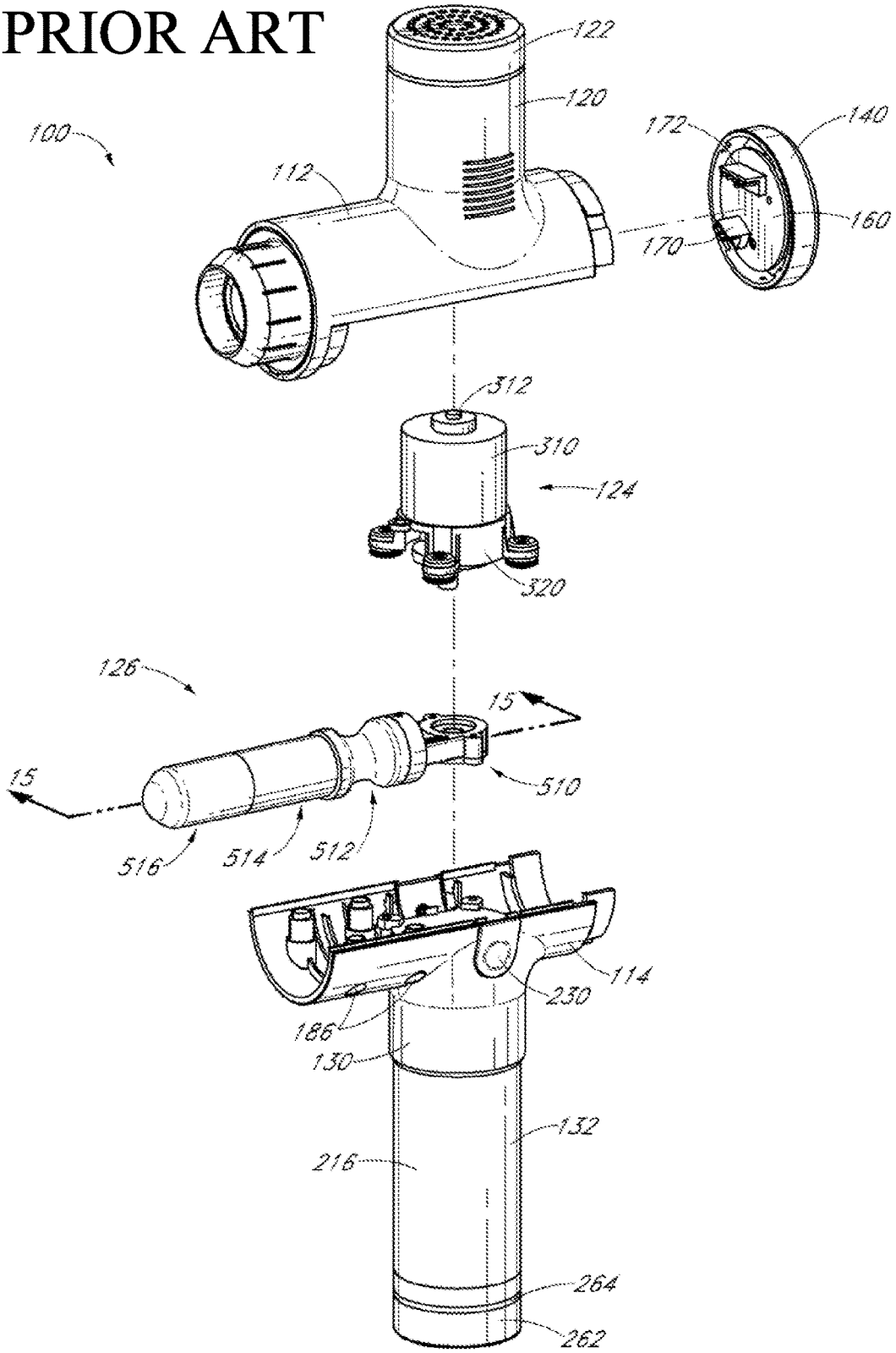
FIG. 1 is an exploded view of a percussion massager in prior arts.
Figure 2:
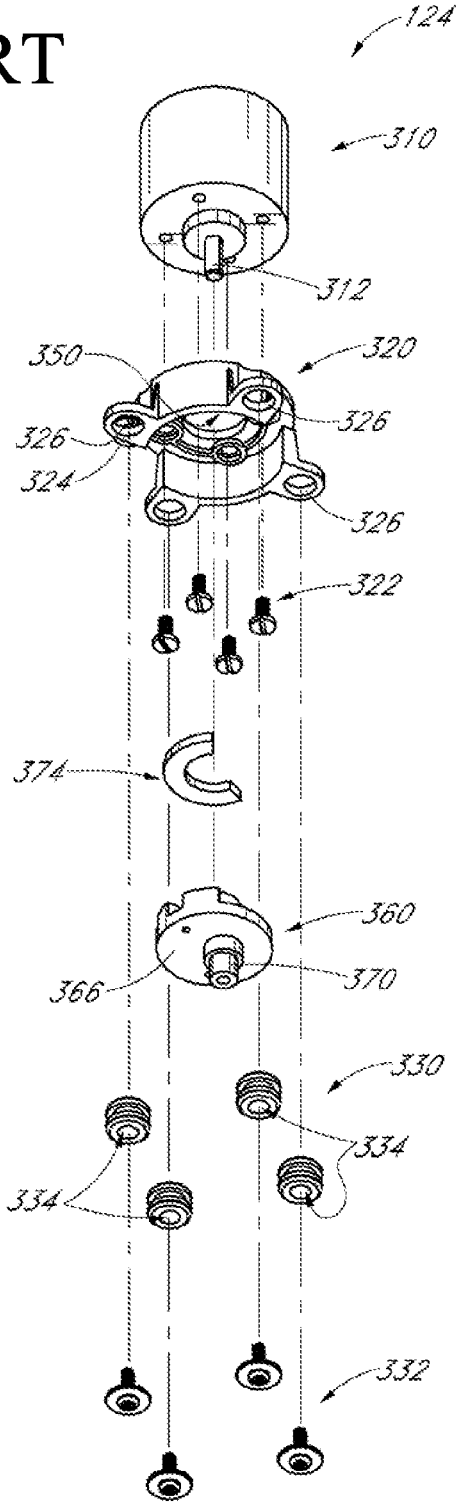
FIG. 2 is an assembly diagram of the motor of the percussion massager shown in the FIG. 1.
Figure 3:
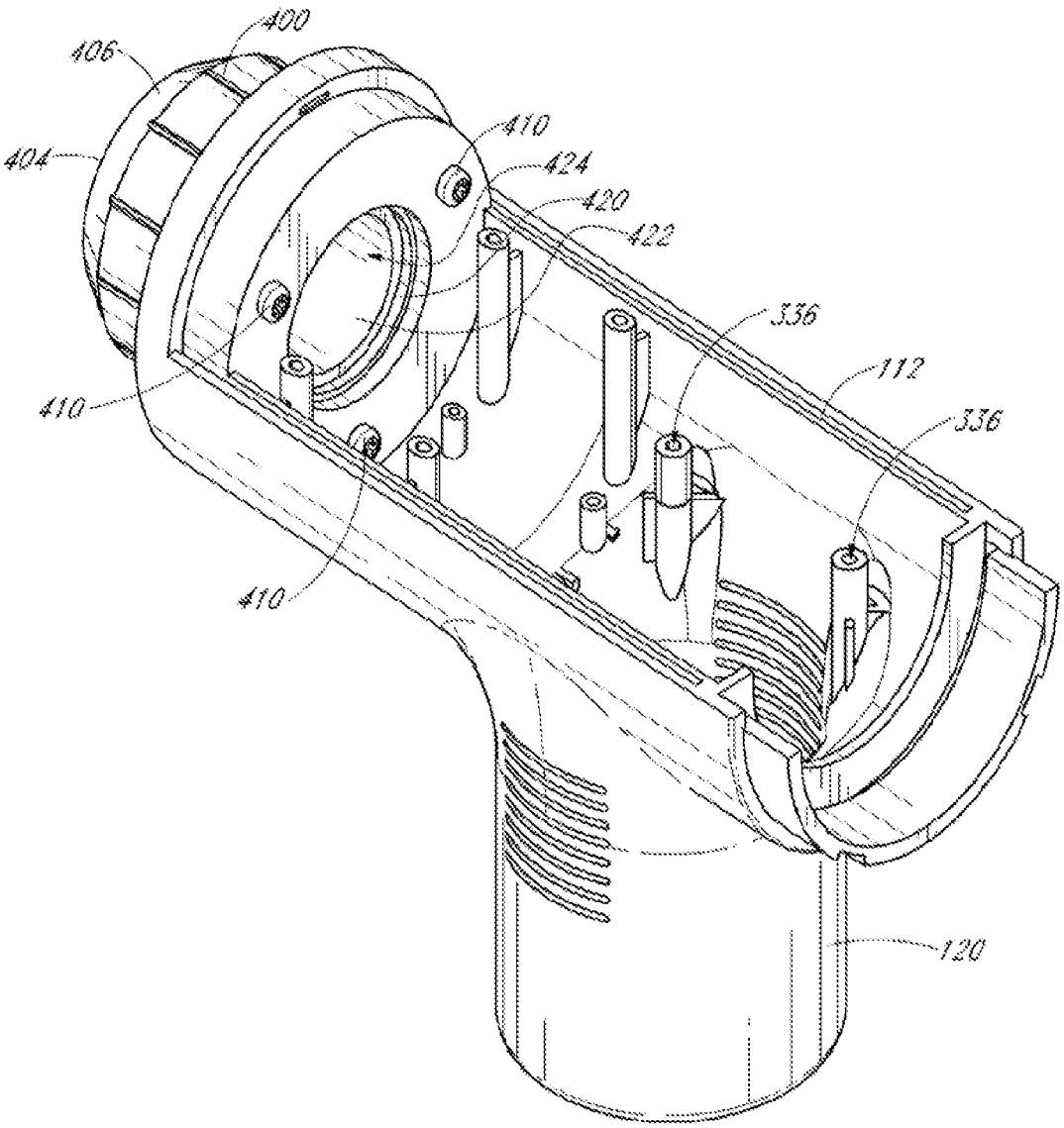
FIG. 3 is a top perspective view of the upper housing of the percussion massager shown in the FIG. 1.

Hereinafter, embodiments of the technical solutions of the invention will be described in detail in conjunction with the accompanying drawings. The following embodiments are only used to clearly illustrate the technical solutions of the invention, and therefore only used as examples, and cannot be used to limit the protection scope of the invention. It should be noted that, unless otherwise specified, the technical or scientific terms used in this application should receive the ordinary meanings understood by those skilled in the art of the invention. In the description of the application, it should be understood that the orientation or position relations indicated by the terms, such as "center", "longitudinal", "transverse", "length", "width", "thickness", "above", "below", "front", "back", "left", "right", "vertical", "horizontal", "top", "bottom", "inside", "outside", "clockwise", "counterclockwise", "axial", "radial", and "circumferential", are based on the orientation or position relations shown in the drawings being referred to, and only for convenient and simple description of the invention, rather than indicating or implying that the device or element must have a specific orientation or be structured and operated in the specific orientation, and thus should not be construed as limitations to the invention. In this application, unless otherwise clearly specified and limited, the terms such as "mount", "link", "connect" and "fix" should receive broad understanding. For example, they can refer to fixed connection, detachable connection or integral formation; mechanical connection or electrical connection; and direct connection, indirect connection via a medium, inner communication inside two elements or interaction between two elements. For those of ordinary skill in the art, the specific meanings of these terms in the invention can be understood according to specific contexts. In this application, unless otherwise clearly specified and limited, the expression that a first feature is "above" or "below" a second feature can mean direct contact between them or indirect contact via a medium.

Figure 4:
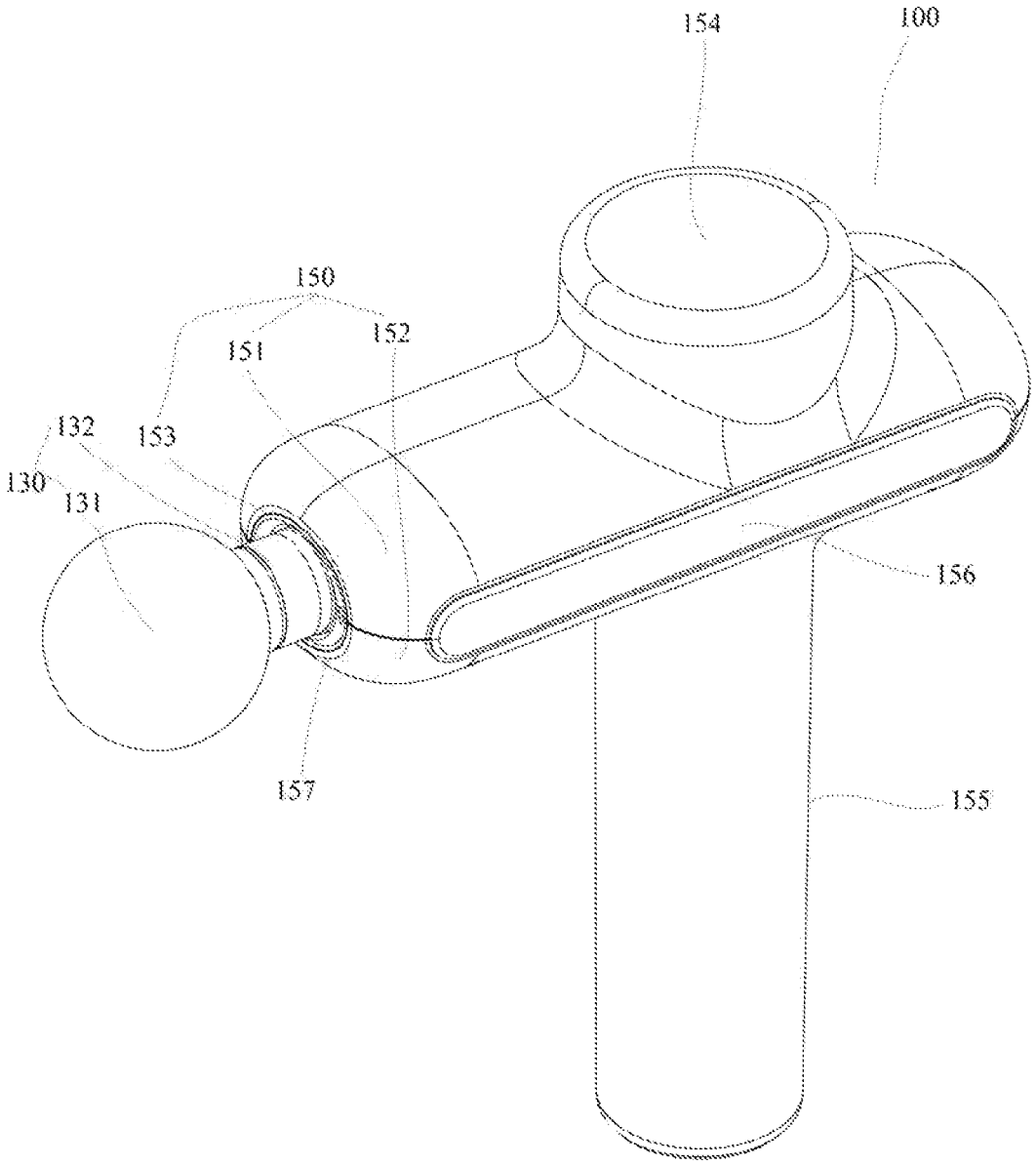
FIG. 4 is a top perspective view of an embodiment of the inventive percussion massager.
Figure 5:
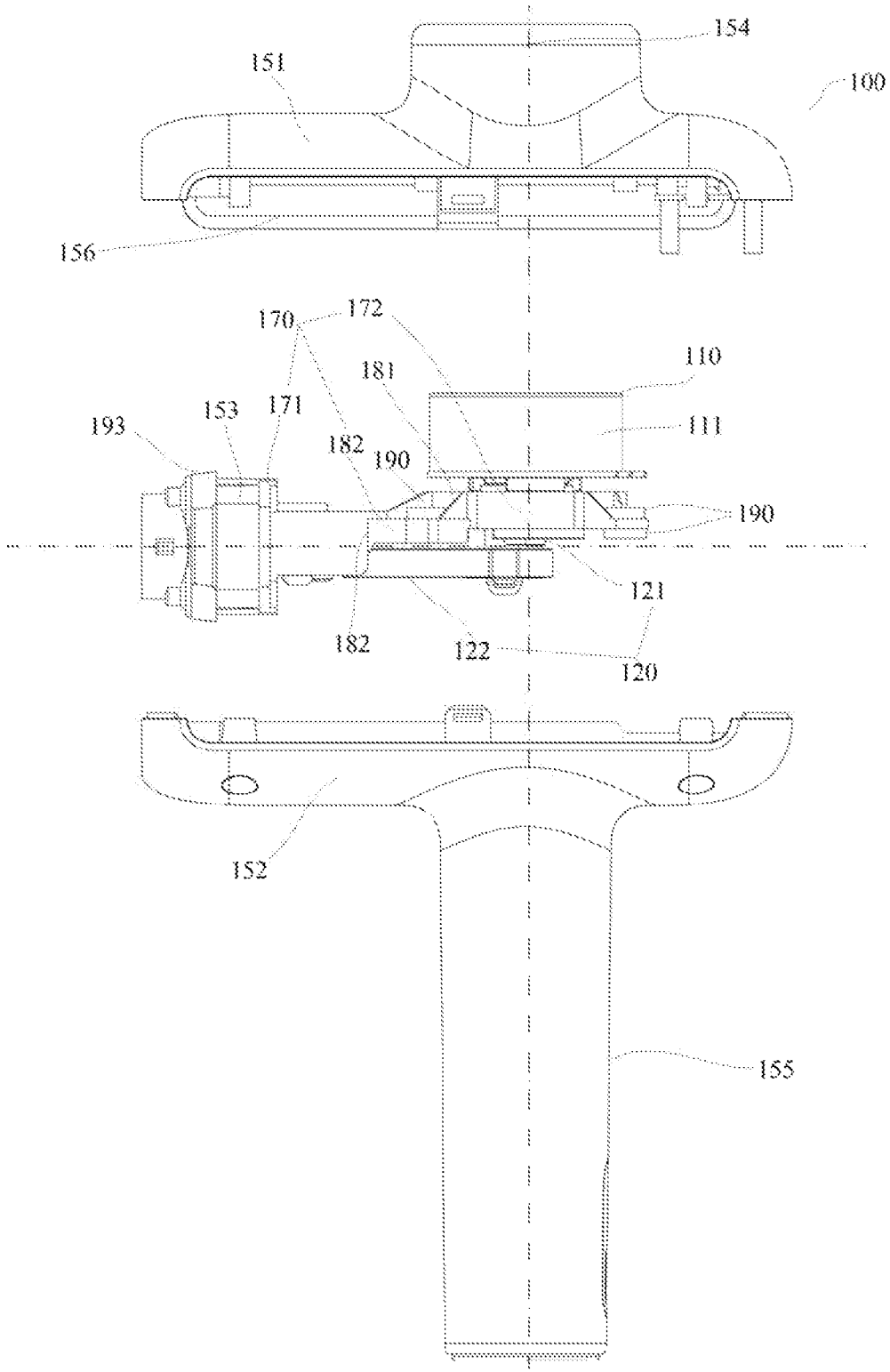
FIG. 5 is an exploded view of the overall structure of the percussion massager shown in FIG. 4.
Figure 6:
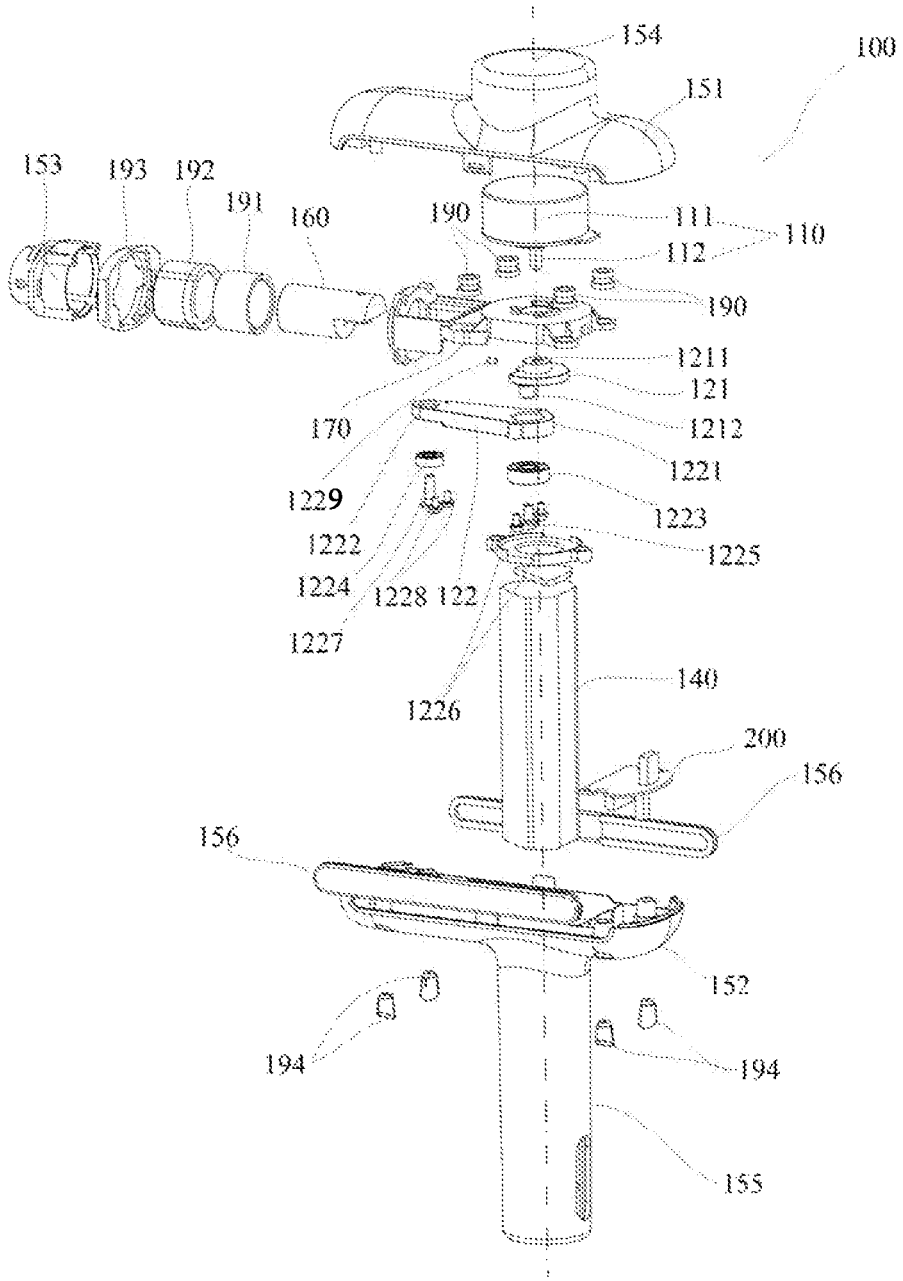
FIG. 6 is an exploded view of the detailed structure of the percussion massager shown in FIG. 4.
Figure 7:
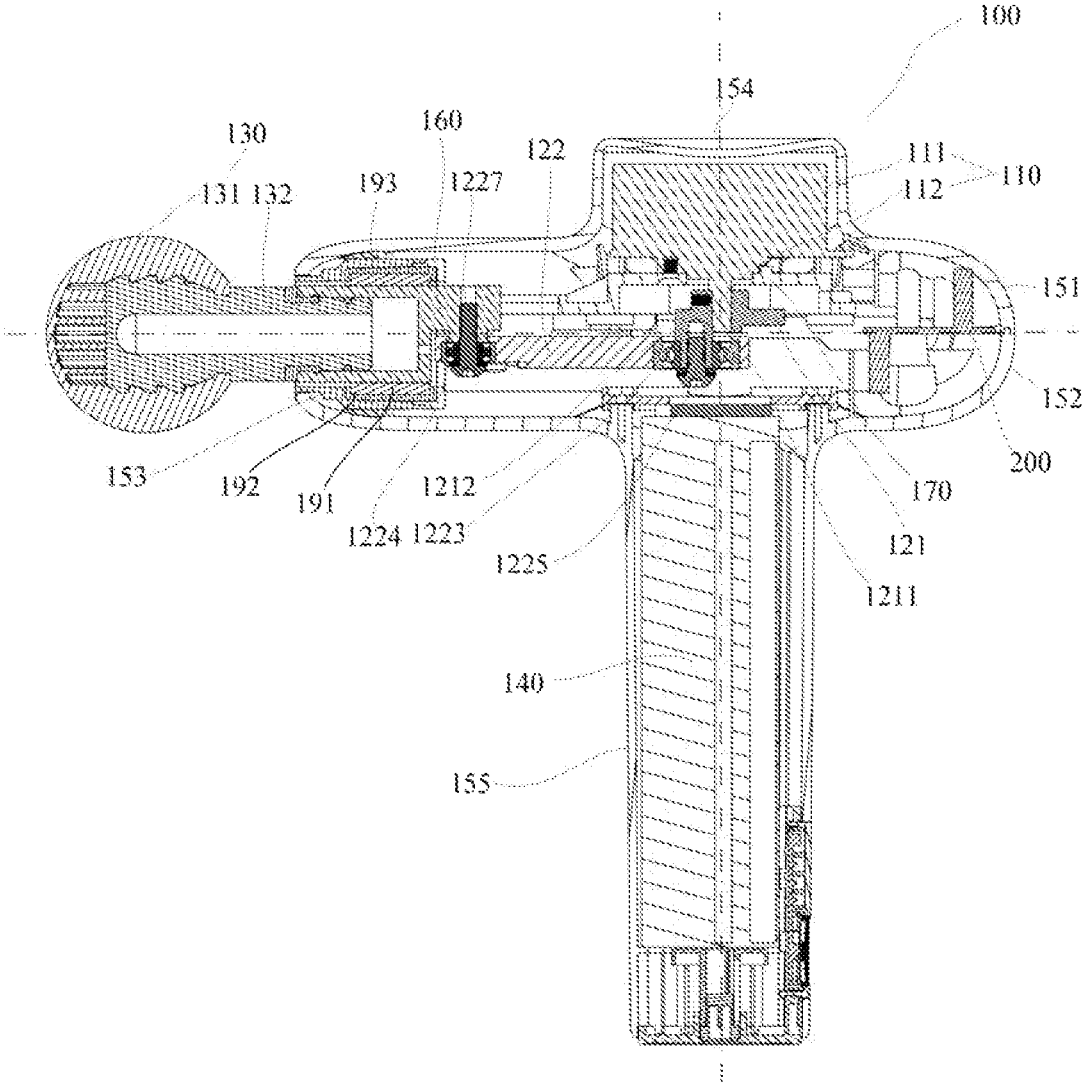
FIG. 7 is a cross-sectional view of the percussion massager shown in FIG. 4 cut along a vertical plane.

As shown in FIGS. 4-7, the inventive percussion massager 100 comprises a motor 110, a reciprocating assembly 120 (FIG. 5), a mallet 130 (FIG. 4; FIG. 7), a power source 140, and a housing 150. The motor 110, the reciprocating assembly 120 and the power source 140 are operably arranged in the housing 150. Part of the mallet 130 is not located in the housing 150. The motor 110 drives the reciprocating assembly 120 under the driving of the power source 140. The motor 110 rotates to drive the reciprocating assembly 120 to make reciprocating linear motion. The reciprocating assembly 120 is mechanically connected with the mallet 130, so that the mallet 130 repeatedly contacts and leaves a user's body at a specific frequency to achieve a therapeutic effect by such repeated striking on the body parts. The motor 110 has a first rotary shaft 112 which defines a vertical axis (and a vertical direction) of the percussion massager 100. The reciprocating linear motion direction of the mallet 130 (i.e. the central axis of the mallet 130) defines a horizontal axis (and a horizontal direction) of the percussion massager 100. The vertical axis and the horizontal axis jointly define a vertical section of the percussion massager 100. The plane comprising the horizontal axis but vertical to the vertical section is a horizontal section of the percussion massager 100. According to one embodiment of the invention, the housing 150 has a hole 157 open in the horizontal direction at the left end. The mallet 130 extends out from the hole 157, and the hole 157 limits the reciprocating assembly 120 connected with the mallet 130 so that it can only reciprocate in the horizontal direction.

With reference to FIGS. 5-8, according to one embodiment of the invention, the reciprocating assembly 120 comprises an eccentric wheel 121 and a link rod 122. According to one embodiment of the invention, the vertical axis sequentially passes through an upper housing 151, a main body 111 of the motor 110, the first rotary shaft 112, the eccentric wheel 121, the link rod 122, the power source 140 and a lower housing 152 from top down. The eccentric wheel 121 has a sheet-like structure with its main plane parallel to the horizontal plane, and comprises a first butt joint 1211 and a second butt joint 1212 both located in different horizontal positions on the eccentric wheel 121, i.e.

the upper side and the lower side of the sheet-like structure of the eccentric wheel 121, respectively, according to one embodiment of the invention. According to one embodiment of the invention, the mass of the eccentric wheel 121 on the first butt joint 1211 side is greater than that on the second butt joint 1212 side.

Figure 8:
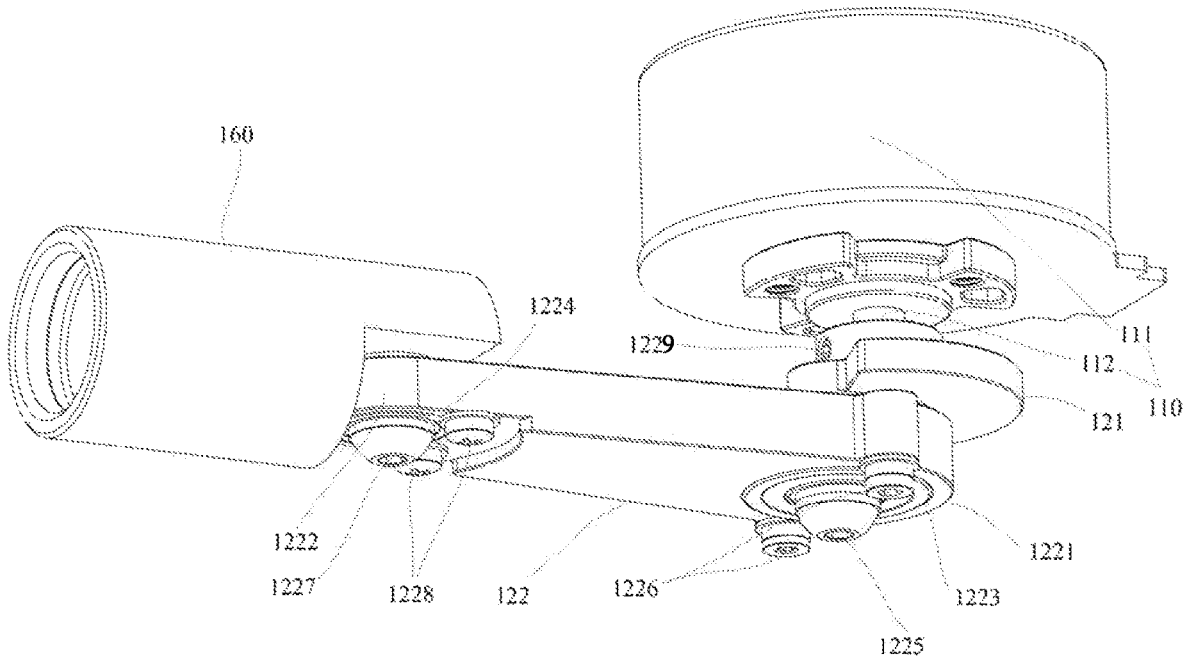
FIG. 8 is a perspective view of the motor, the reciprocating assembly and the connector of the percussion massager shown in FIG. 4.

With reference to FIGS. 6-8, according to one embodiment of the invention, the link rod 122 has a strip structure including a right end 1221 and a left end 1222, and extends leftwards from the right end 1221 to the left end 1222 along the horizontal direction. According to one embodiment of the invention, the mass of the right end 1221 is greater than that of the left end 1222. According to one embodiment of the invention, the part between the right end 1221 and the left end 1222 of the link rod 122 is prepared from a deformable material. The first butt joint 1211 is fixedly connected with the first rotary shaft 112, and the second butt joint 1212 is rotatably connected with the right end 1221. The mallet 130 is connected with the left end 1222 detachably or otherwise. Under the driving of the power source 140, the first rotary shaft 112 rotates the eccentric wheel 121 via the first butt joint 1211, and the eccentric wheel 121 drives the link rod 122 via the second butt joint 1212 to make the link rod 122 reciprocate linearly along the horizontal direction, so that the mallet 130 (FIG. 7) connected with the left end 1222 of the link rod 122 repeatedly contacts and leaves a body at a specific frequency.

With further reference to FIGS. 6-8, according to one embodiment of the invention, the first butt joint 1211 of the eccentric wheel 121 has a hole. The first rotary shaft 112 penetrates into the hole to get fixedly connected with the eccentric wheel 121. According to one embodiment of the invention, a screw 1229 (FIG. 6; FIG. 8) horizontally passes through the first butt joint 1211 of the eccentric wheel 121 to get abutted against the first rotary shaft 112 in the hole, so that the first rotary shaft 112 and the eccentric wheel 121 are fixedly connected with each other. According to one embodiment of the invention, the second butt joint 1212 of the eccentric wheel 121 has a second rotary shaft. The right end 1221 of the link rod 122 has a hole in which the secondary rotary shaft is rotatably inserted. When rotating around the vertical axis eccentrically, the second rotary shaft drives the link rod 122 to reciprocate linearly along the horizontal direction. According to one embodiment of the invention, a first bearing 1223 in the hole of the right end 1221 of the link rod 122 is rotatably located between the hole and the second rotary shaft. According to one embodiment of the invention, a screw 1225 passes through the first bearing 1223 and the hole to get locked in the second rotary shaft to thereby connect the eccentric wheel 121 with the link rod 122 in a rotatable manner. According to one embodiment of the invention, a screw 1226 passes through the link rod 122 from two sides of the hole of the right end 1221 to get locked in the eccentric wheel 121.

With further reference to FIGS. 6-8, according to one embodiment of the invention, a connector 160 is located between the mallet 130 and the left end 1222 of the link rod, and has its right end rotatably connected with the left end 1222 of the link rod and its left end connected with the mallet 130 detachably or otherwise. According to one embodiment of the invention, the left end 1222 of the link rod has a hole where a second bearing 1224 is arranged. A screw 1227 passes through the second bearing 1224 and the hole to get locked in the right end of the connector 160. According to one embodiment of the invention, a screw 1228 passes through the link rod 122 from two sides of the hole of the left end 1222 of the link rod to get locked in the right end of the connector 160. According to one embodiment of the invention, a notch is formed at the right end of the connector 160 to receive the left end 1222 of the link rod. According to one embodiment of the invention, a sleeve is formed at the left end of the connector 160 and detachably connected with the mallet 130.

With reference to FIGS. 5-7, according to one embodiment of the invention, any part of the motor 110, the reciprocating assembly 120 or the mallet 130 comes into no direct contact with any part of the housing 150 (FIG. 1). According to one embodiment of the invention, the fixing frame 170 is mounted in the housing 150 to divide the space inside the housing 150 into an upper space and a lower space. The motor 110, the reciprocating assembly 120 and the mallet 130 are directly mounted on the fixing frame to thereby avoid direct contact with the housing 150. According to one embodiment of the invention, the housing 150 comprises an upper housing 151 and a lower housing 152 interlocked with each other. The upper space is located between the fixing frame 170 and the upper housing 151, and the lower space is located between the fixing frame 170 and the lower housing 152. According to one embodiment of the invention, the main body 111 of the motor and the reciprocating assembly 120 are located in the upper space and the lower space, respectively.

With reference to FIGS. 5-10, according to one embodiment of the invention, the fixing frame 170 comprises a left segment 171 and a right segment 172. The main body 111 of the motor is fixed on the right segment 172. The reciprocating assembly 120 is mounted at the left segment 171 in such a way that it can only make reciprocating linear motion along the horizontal direction. According to one embodiment of the invention, the right segment comprises a platform 173 and a hole 174. The main body 111 of the motor is located in the upper space and fixed on the platform 173. The first rotary shaft 112 passes through the hole 174 and extends to the lower space to get operably connected with the reciprocating assembly 120, so as to transmit the power of the motor 110 to the reciprocating assembly 120. According to one embodiment of the invention, the hole 174 is surrounded by the platform 173. According to one embodiment of the invention, the left segment 171 has a guide ring 175, and the reciprocating assembly 120 has its freedom of motion so limited by the guide ring 175 that it can only make reciprocating linear motion along the horizontal direction. According to one embodiment of the invention, the platform 173 is parallel to the horizontal axis, and the plane defined by the opening of the guide ring 175 is parallel to the vertical axis. The horizontal axis passes through the center of the guide ring 175. The platform 173 is located above the horizontal axis. According to one embodiment of the invention, the left segment 171 and the right segment 172 are integrally formed of a rigid material to constitute the fixing frame 170.

With further reference to FIGS. 5-10, according to one embodiment of the invention, the fixing frame 170 further comprises a middle segment 182 between the left segment 171 and the right segment 172. According to one embodiment of the invention, the left segment 171, the middle segment 182 and the right segment 172 are integrally formed of a rigid material to constitute the fixing frame 170. According to one embodiment of the invention, the reciprocating assembly 120 extends below the middle segment 182.

With reference to FIGS. 5-10, according to one embodiment of the invention, the first rotary shaft 112 passes through the hole 174 of the right segment 172 of the fixing frame 170 and extends to the lower space to get fixedly connected with the eccentric wheel 121. The eccentric wheel 121 is rotatably connected with the right end 1221 of the link rod 122. The connector 160 has its right end rotatably connected with the left end 1222 of the link rod 122, and its left end connected with the mallet 130 detachably or otherwise. According to one embodiment of the invention, the connector 160 passes through the guide ring 175 so that it has the freedom of motion limited by the guide ring 175 and can only make reciprocating linear motion along the horizontal direction, to thereby drive the mallet 130 to perform reciprocating linear striking along the horizontal direction. According to one embodiment of the invention, the vertical axis sequentially passes through the motor 110, the right segment 172 of the fixing frame 170, the eccentric wheel 121 and the right end 1221 of the link rod 122 from top down. According to one embodiment of the invention, the link rod 122 extends below the middle segment 182 of the fixing frame 170, and has its left end 1222 rotatably connected with the right end of the connector 160 on the left side of the middle segment 182. The left end of the connector 160 is connected with the mallet 130 detachably or otherwise beyond the left segment 171 of the fixing frame 170.

With reference to FIGS. 8-12, according to one embodiment of the invention, the left segment 171 of the fixing frame 170 has a lip side 176 extending leftwards from the guide ring 175 along the horizontal axis direction. The connector 160 has its freedom of motion limited by the lip side 176 so that it can only make reciprocating linear motion along the horizontal axis to thereby drive the mallet 130 to perform reciprocating linear striking along the horizontal direction.

With reference to FIGS. 9-12, according to one embodiment of the invention, the fixing frame 170 has aprons 177, 178 and 179 for strengthening the structure. The aprons 177, 178 and 179 extend vertically from the edge of the fixing frame 170. According to one embodiment of the invention, the aprons 177, 178 and 179 extend downwards vertically from the edge of the fixing frame 170. According to one embodiment of the invention, the apron 177 of the right segment 172 of the fixing frame 170 is located above the horizontal axis. According to one embodiment of the invention, the apron 178 of the middle segment 182 of the fixing frame 170 is located below the horizontal axis. According to one embodiment of the invention, the aprons 178 and 179 of the middle segment 182 of the fixing frame 170 are located above and below the horizontal axis. According to one embodiment of the invention, the lowest points of the aprons 177, 178 and 179 of the fixing frame 170 have different distances to the horizontal plane, and the different distances include a first distance (the distance from the apron 177 to the horizontal plane), a second distance (the distance from the apron 178 to the horizontal plane), and a third distance (the distance from the apron 179 to the horizontal plane). According to one embodiment of the invention, the third distance is larger than the first distance, and the first distance is larger than the second distance.

With reference to FIGS. 8-12, according to one embodiment of the invention, the connection between the right segment 172 and the middle segment 182 of the fixing frame 170 is provided with a plurality of ribs 180 and 181 connected to counteract the torque caused by the motor 110 and the reciprocating assembly 120. The planes defined by the ribs 180 and 181 are vertical to the horizontal plane. According to one embodiment of the invention, the plane defined by the rib 180 is not parallel to that defined by the rib 181.

Figure 9:
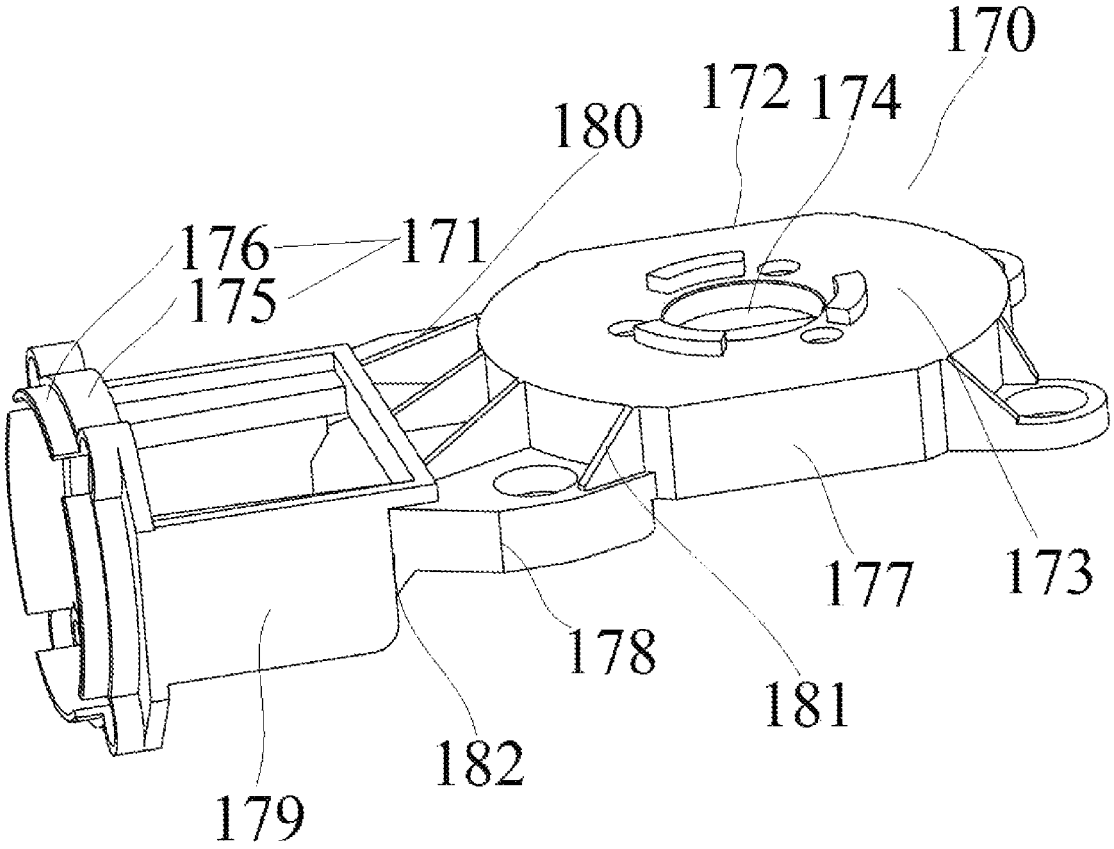
FIG. 9 is a perspective view of the fixing frame of the percussion massager shown in FIG. 4.
Figure 10:
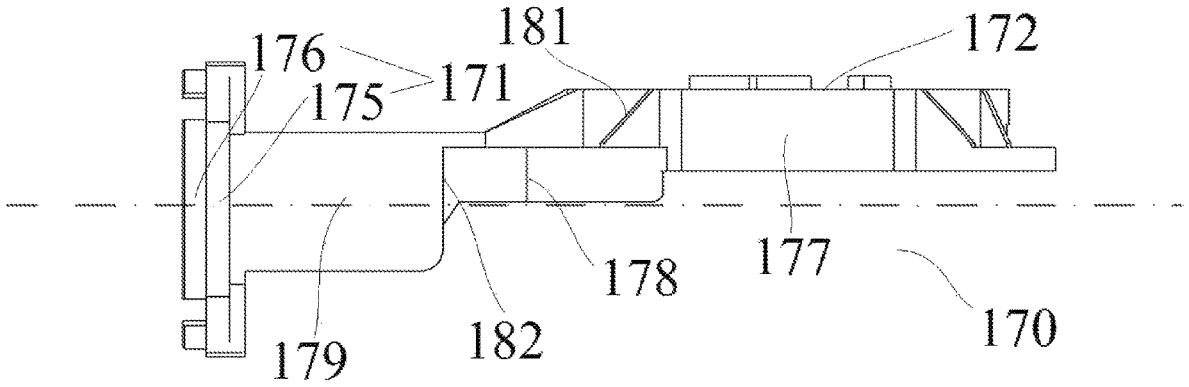
FIG. 10 is a front view of the fixing frame shown in FIG. 9.
Figure 11:
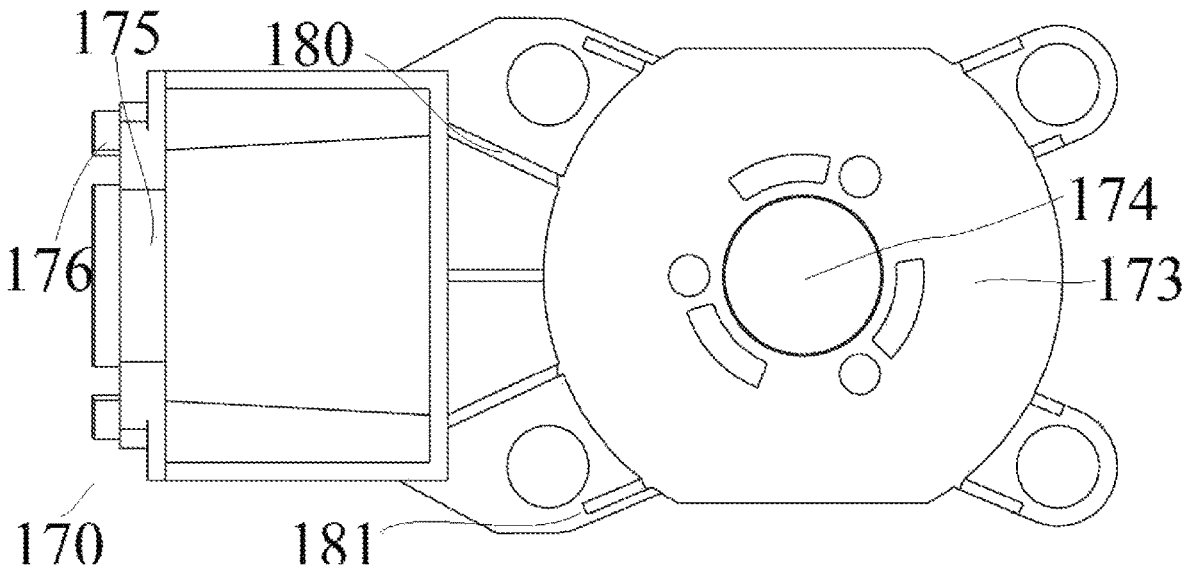
FIG. 11 is a top view of the fixing frame shown in FIG. 9.
Figure 12:
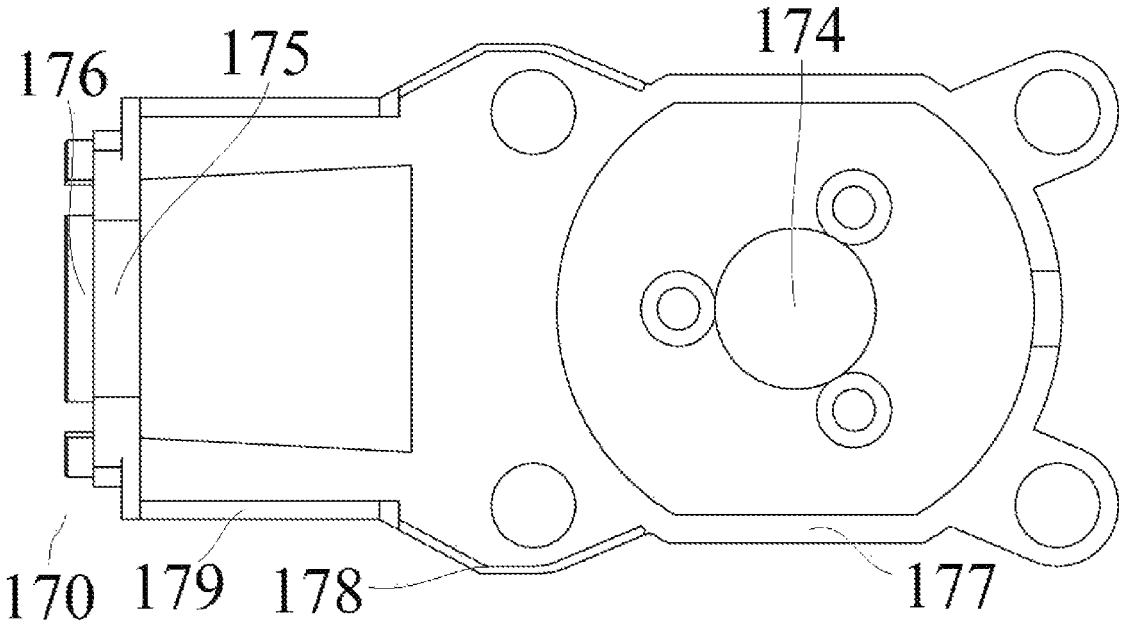
FIG. 12 is a bottom view of the fixing frame shown in FIG. 9.

With reference to FIG. 5, FIG. 6 and FIG. 9, according to one embodiment of the invention, the connections between the fixing frame 170 and the housings 151 and 152 are provided with damping devices 190. According to one embodiment of the invention, the damping devices 190 are made of an elastic material (such as rubber). According to one embodiment of the invention, the damping devices 190 are arranged in the periphery of the right segment 172 of the fixing frame 170. According to one embodiment of the invention, a lantern ring 191 made of a nonelastic material wraps the connector 160. According to one embodiment of the invention, a lantern ring 192 made of an elastic material (such as rubber) wraps the connector 160. According to one embodiment of the invention, the connector 160 wrapped by the multiple layers of the lantern rings has its freedom of motion restricted by the left segment 171 of the fixing frame 170, so that it can only make reciprocating linear motion along the horizontal axis under the driving of the motor 110.

With reference to FIGS. 4-7 and FIG. 9, according to one embodiment of the invention, the housing 150 further comprises a front housing 153 equipped with a hole 157 and located at the leftmost end of the housing 150. The mallet 130 extends out of the housing 150 from the hole 157 of the front housing 153. According to one embodiment of the invention, the front housing 153 is locked with the left segment 171 of the fixing frame 170. According to one embodiment of the invention, the front housing 153 is locked with the guide ring 175 of the left segment 171 of the fixing frame 170. According to one embodiment of the invention, a damping ring 193 is sandwiched between the front housing 153 and the connector 160. According to one embodiment of the invention, the damping ring 193 is held between the upper housing 151 and the lower housing 152. According to one embodiment of the invention, the damping ring 193 is made of an elastic material (such as rubber). According to one embodiment of the invention, the upper housing 151 is locked with the lower housing 152 via a screw to form the housing 150, and the threaded hole is equipped with a damping bushing 194 to isolate the screw from the housing.

With reference to FIG. 4-7, according to one embodiment of the invention, the upper housing 151 follows the contour of the main body 111 of the motor 110 to form a bump structure 154. According to one embodiment of the invention, a handgrip 155 for an operator to hold is formed from the lower housing 152. According to one embodiment of the invention, the power source 140 comprises a battery. According to one embodiment of the invention, the battery is installed in the space inside the handgrip 155.

With reference to FIGS. 5-6, according to one embodiment of the invention, the vertical axis passes through (or runs through) part or all of the following structures: the bump structure 154 of the upper housing 151, the motor 110, the right segment 172 of the fixing frame 170, the eccentric wheel 121, the link rod 122, the power source 140, and the handgrip 155 formed from the lower housing 152. According to one embodiment of the invention, the vertical axis sequentially passes through part or all of the following structures from top down: the bump structure 154 of the upper housing 151, the motor 110, the right segment 172 of the fixing frame 170, the eccentric wheel 121, the link rod 122, the power source 140, and the handgrip 155 formed from the lower housing 152.

With further reference to FIGS. 5-6, according to one embodiment of the invention, the horizontal axis passes through (or runs through) part or all of the following structures: the front housing 153, the damping ring 193, the elastic lantern ring 192, the nonelastic lantern ring 191, the connector 160, the left segment 171 of the fixing frame 170, the middle segment 182 of the fixing frame 170, the right segment 172 of the fixing frame 170, the upper housing 151 and the lower housing 152. According to one embodiment of the invention, the horizontal axis sequentially passes through (or runs through) part or all of the following structures from left to right: the front housing 153, the damping ring 193, the elastic lantern ring 192, the nonelastic lantern ring 191, the connector 160, the left segment 171 of the fixing frame 170, the middle segment 182 of the fixing frame 170, the right segment 172 of the fixing frame 170, the upper housing 151 and the lower housing 152.

With reference to FIG. 4 and FIG. 7, according to one embodiment of the invention, the mallet 130 comprises a head 131 and a handle 132 engaged with the sleeve at the left end of the connector 160. The head 131 may be of various structures and materials, such as ball shape (like a fist), crescent shape (like the part of a hand between the thumb and the index finger), tip shape (like a fingertip), sheet shape (like a hand knife), Y shape (like two fingers), small disc (like a finger pulp), sucking disc and elastic head capable of moving like an accordion, suitable for generating therapeutic effects by repeatedly contacting and leaving specific body parts.

With reference to FIGS. 4-6, according to one embodiment of the invention, a control circuit 200 is electrically connected with the power source 140 and the motor 110, to provide part or all of the following functions: switching, timing, power controlling, striking frequency controlling and striking strength compensating. According to one embodiment of the invention, the control circuit 200 is mounted at the rightmost end inside the housing 150. According to one embodiment of the invention, decoration boards 156 are adhered to joints of the upper housing 151 and the lower housing 152 on two sides of the percussion massager 100. The inventive percussion massager 100 can be used in various directions, and is not limited to the directions shown in the drawings.

The embodiments mentioned hereinabove are only used to illustrate the technical solution of the present invention, but not to limit it. Although the present invention is described in detail with reference to the foregoing embodiments, those of ordinary skill in the art should understand that modifications can be made on the technical solutions recorded in the foregoing embodiments, or equivalent replacements can be made on some or all of the technical features. These modifications or replacements do not make the essence of the corresponding technical solutions deviate from the scope of the technical solutions of the embodiments of the present invention, and should be covered by the scope of the claims and the specification of the present invention.

What is claimed is:

1. A percussion massager, comprising:

a motor;

a reciprocating assembly;

a mallet;

a power source;

a housing; and a fixing frame, wherein:

the motor, the reciprocating assembly and the power source are operably arranged in the housing;

the motor comprises a main body and a first rotary shaft;

part of the mallet is not located in the housing;

the first rotary shaft of the motor and the reciprocating assembly are operably mechanically connected;

the reciprocating assembly is mechanically connected with the mallet;

the fixing frame is mounted in the housing;

the main body of the motor and the reciprocating assembly are mounted on the fixing frame;

the main body of the motor and the reciprocating assembly are mounted in the housing via the fixing frame only;

when the motor is electrically connected with the power source, it rotates to drive the reciprocating assembly to reciprocate under the driving of the power source, thereby driving the mallet to make reciprocating linear motion for repeated striking;

the first rotary shaft defines a vertical axis of the percussion massager;

the reciprocating linear motion direction of the mallet defines a horizontal axis of the percussion massager;

the housing comprises an upper housing and a lower housing;

the fixing frame divides the space inside the housing into an upper space and a lower space;

the main body of the motor is located in the upper space;

the reciprocating assembly is located in the lower space;

the fixing frame comprises a left segment and a right segment;

the main body of the motor is fixed at the right segment;

the reciprocating assembly is mounted at the right segment;

the right segment comprises a platform and a hole surrounded by the platform;

the main body of the motor is fixed on the platform;

the first rotary shaft passes through the hole and extends to the lower space to get operably connected with the reciprocating assembly;

the left segment has a guide ring, which limits the freedom of motion of the reciprocating assembly, so that the reciprocating assembly can only make reciprocating linear motion along the direction of the horizontal axis;

the platform is parallel to and above the horizontal axis;

a plane defined by an opening of the guide ring is parallel to the vertical axis;

the horizontal axis passes through the center of the guide ring;

the fixing frame further comprises a middle segment between the left and right segments;

the reciprocating assembly extends below the middle segment;

the left segment, the middle segment and the right segment are integrally formed of a rigid material to constitute the fixing frame;

the reciprocating assembly comprises an eccentric wheel and a link rod;

the vertical axis sequentially passes through the upper housing, the main body of the motor, the first rotary shaft, the eccentric wheel, the link rod and the lower housing from top down:

the eccentric wheel has a sheet-like structure with its main plane parallel to the horizontal axis;

the eccentric wheel comprises a first butt joint and a second butt joint;

the first butt joint and the second butt joint are located in different horizontal positions on the eccentric wheel;

the first butt joint is located on the upper side of the sheet-like structure of the eccentric wheel:

the second butt joint is located on the lower side of the sheet-like structure of the eccentric wheel;

the mass of the eccentric wheel on the first butt joint side is greater than that on the second butt joint side;

the link rod has a strip structure and comprises a right end and a left end;

the link rod extends leftwards from the right end to the left end along the horizontal direction;

the mass of the right end is greater than that of the left end;

the part between the right end of the link rod and the left end of the link rod is prepared from a deformable material;

the first butt joint is fixedly connected with the first rotary shaft;

the second butt joint is rotatably connected with the right end of the link rod;

the mallet is detachably connected with the left end of the link rod;

when the motor is electrically connected with the power source, the first rotary shaft rotates the eccentric wheel via the first butt joint, and the eccentric wheel drives, via the second butt joint, the link rod to make reciprocating linear motion along the horizontal axis direction, so that the mallet connected with the left end of the link rod makes reciprocating linear motion to deliver repeated striking;

the first butt joint of the eccentric wheel has a hole;

the first rotary shaft passes through the hole of the first butt joint to get fixedly connected with the eccentric wheel;

a screw horizontally passes through the first butt joint of the eccentric wheel to get abutted against the first rotary shaft in the hole of the first butt joint;

the second butt joint of the eccentric wheel has a second rotary shaft;

the right end of the link rod has a hole;

the second rotary shaft is rotatably inserted in the hole of the right end of the link rod;

when rotating around the vertical axis, the second rotary shaft drives the link rod to reciprocate linearly along the horizontal axis direction;

a first bearing in the hole of the right end of the link rod is rotatably located between the hole and the second rotary shaft; and a screw passes through the first bearing and the hole to get locked in the second rotary shaft, thereby rotatably connecting the eccentric wheel with the link rod.

2. The percussion massager in claim 1, wherein:

a connector is arranged between the mallet and the left end of the link rod;

the right end of the connector is rotatably connected with the left end of the link rod; and the left end of the connector is detachably connected with the mallet.

3. The percussion massager in claim 2, wherein:

the left end of the link rod has a hole;

a second bearing is arranged in the hole of the left end of the link rod; and a screw passes through the second bearing and the hole to get locked in the right end of the connector.

4. The percussion massager in claim 3, wherein:

a notch is formed at the right end of the connector to receive the left end of the link rod; and a sleeve is formed at the left end of the connector and detachably connected with the mallet.

5. The percussion massager in claim 4, wherein:

the connector passes through the guide ring; and the connector has its freedom of motion limited by the guide ring so that it can only reciprocate linearly along the horizontal direction.

6. The percussion massager in claim 5, wherein:

the left end of the fixing frame has a lip side; and the lip side extends leftwards from the guide ring along the horizontal axis direction.

7. The percussion massager in claim 6, wherein:

the fixing frame further comprises:

a first apron located at the right segment;

a second apron located at the middle segment; and a third apron located at the left segment; and the first apron, the second apron and the third apron extend vertically downwards from an edge of the fixing frame.

8. The percussion massager in claim 7, wherein:

the first apron is located above the horizontal axis; and the second apron is located below the horizontal axis.

9. The percussion massager in claim 8, wherein:

a distance from a lowest point of the first apron to the horizontal plane passing through the horizontal axis is a first distance;

a distance from a lowest point of the second apron to the horizontal plane passing through the horizontal axis is a second distance;

a distance from a lowest point of the third apron to the horizontal plane passing through the horizontal axis is a third distance;

the third distance is larger than the first distance; and the first distance is larger than the second distance.

10. The percussion massager in claim 9, wherein:

the connection between the right segment and the middle segment of the fixing frame is provided with a plurality of ribs including a first rib and a second rib;

the planes defined by the plurality of ribs are perpendicular to the horizontal axis; and the plane defined by the first rib is not parallel to that defined by the second rib.

11. The percussion massager in claim 10, wherein:

damping devices are arranged at the connections between the fixing frame and the upper housing and the lower housing; and the damping devices are arranged in the periphery of the right end of the fixing frame.

12. The percussion massager in claim 11, wherein:

the connector is wrapped by a nonelastic lantern ring;

the nonelastic lantern ring is wrapped by an elastic lantern ring; and the connector wrapped by the multiple layers of the lantern rings has its freedom of motion restricted by the left end of the fixing frame, so that it can make reciprocating linear motion along the horizontal axis direction under the driving of the motor.

13. The percussion massager in claim 12, wherein:

the housing further comprises a front housing;

the front housing has a hole and is located at the leftmost end of the housing; and the mallet extends out of the housing from the hole of the front housing.

14. The percussion massager in claim 13, wherein:

a damping ring is sandwiched between the front housing and the connector; and the damping ring is held between the upper housing and the lower housing.

15. The percussion massager in claim 14, wherein:

the upper housing follows the contour of the main body of the motor to form a bump structure;

a handgrip is formed from the lower housing;

the power source comprises a battery; and the battery is installed in the space inside the handgrip.

16. The percussion massager in claim 15, wherein the vertical axis passes through all of the following structures: the bump structure of the upper housing, the motor, the right segment of the fixing frame, the eccentric wheel, the link rod, the battery and the handgrip formed from the lower housing.

17. The percussion massager in claim 15, wherein the horizontal axis passes through all of the following structures: the front housing, the damping ring, the elastic lantern ring, the nonelastic lantern ring, the connector, the left segment of the fixing frame, the middle segment of the fixing frame, the right segment of the fixing frame, the upper housing and the lower housing.

* * * * *